US010751714B2

(12) United States Patent
Kronsbein et al.

(10) Patent No.: US 10,751,714 B2
(45) Date of Patent: Aug. 25, 2020

(54) CARTRIDGE FOR TESTING A SAMPLE

(71) Applicant: Boehringer Ingelheim Vetmedica GmbH, Ingelheim am Rhein (DE)

(72) Inventors: Matthias Kronsbein, Kaiserslautern (DE); Lutz Weber, Zweibruecken (DE); Hannah Schmolke, Braunschweig (DE)

(73) Assignee: BOEHRINGER INGELHEIM VETMEDICA GMBH, Ingelheim am Rhein (DE)

( * ) Notice: Subject to any disclaimer, the term of this patent is extended or adjusted under 35 U.S.C. 154(b) by 320 days.

(21) Appl. No.: 15/725,333

(22) Filed: Oct. 5, 2017

(65) Prior Publication Data

US 2018/0099277 A1 Apr. 12, 2018

(30) Foreign Application Priority Data

Oct. 7, 2016 (EP) ..... 16020375

(51) Int. Cl.
*B01L 3/00* (2006.01)

(52) U.S. Cl.
CPC ... *B01L 3/502715* (2013.01); *B01L 3/502707* (2013.01); *B01L 3/502723* (2013.01); *B01L 3/502738* (2013.01); *B01L 2200/027* (2013.01); *B01L 2200/0689* (2013.01); *B01L 2200/142* (2013.01); *B01L 2300/04* (2013.01); *B01L 2300/041* (2013.01); *B01L 2300/042* (2013.01); *B01L 2300/048* (2013.01); *B01L 2300/0627* (2013.01); *B01L 2300/0809* (2013.01); *B01L 2300/0887* (2013.01); *B01L 2400/0487* (2013.01)

(58) Field of Classification Search
CPC ..... B01L 3/502715; B01L 3/502707; B01L 3/502723; B01L 3/502738; B01L 2200/142; B01L 2300/04; B01L 2400/0487; B01L 2200/027; B01L 2300/042; B01L 2300/0627; B01L 2300/0887; B01L 2300/048; B01L 2200/0689; B01L 2300/041; B01L 2300/0809
See application file for complete search history.

(56) References Cited

U.S. PATENT DOCUMENTS

| | | | |
|---|---|---|---|
| 5,096,669 | A | 3/1992 | Lauks et al. |
| 6,488,897 | B2 | 12/2002 | Dubrow et al. |
| 9,110,044 | B2 | 8/2015 | Gumbrecht et al. |
| 9,156,032 | B2 | 10/2015 | Peterson et al. |
| 2002/0042125 | A1 | 4/2002 | Petersen et al. |

(Continued)

FOREIGN PATENT DOCUMENTS

| | | | |
|---|---|---|---|
| DE | 20 2006 020 469 | U1 | 11/2008 |
| GB | 2512141 | A | 9/2014 |

*Primary Examiner* — Dennis White
(74) *Attorney, Agent, or Firm* — David S. Safran; Roberts Calderon Safran & Cole, P.C.

(57) ABSTRACT

A cartridge for testing a biological sample. The cartridge has a closure element that is fastened to the cartridge in a form-fit or interlocking manner and is a multi-component injection molded closure part having an integrated seal so as to be able to fluidically close a receiving cavity having an integrated vent. The cartridge also has a film cover and an additional aluminum cover in the region of storage cavities for liquid reagents.

22 Claims, 5 Drawing Sheets

(56) References Cited

U.S. PATENT DOCUMENTS

| | | | | |
|---|---|---|---|---|
| 2002/0143293 | A1* | 10/2002 | Francavilla | B01L 3/0275 604/116 |
| 2009/0285719 | A1 | 11/2009 | Hirano et al. | |
| 2014/0220702 | A1* | 8/2014 | Johnson | B01L 3/502715 436/180 |
| 2014/0272719 | A1 | 9/2014 | Liu et al. | |
| 2014/0378341 | A1* | 12/2014 | Glezer | B01L 3/5027 506/9 |
| 2015/0241319 | A1 | 8/2015 | Chiesl et al. | |

* cited by examiner

CARTRIDGE FOR TESTING A SAMPLE

BACKGROUND OF THE INVENTION

Field of the Invention

The present invention relates to a cartridge for testing a biological sample, the cartridge comprising a main body having a plurality of channels and cavities, and a cover for the channels and cavities.

Preferably, the present invention deals with analysing and testing a sample, in particular from a human or animal, particularly preferably for analytics and diagnostics, for example with regard to the presence of diseases and/or pathogens and/or for determining blood counts, antibodies, hormones, steroids or the like. Therefore, the present invention is in particular within the field of bioanalytics. A food sample, environmental sample or another sample may optionally also be tested, in particular for environmental analytics or food safety and/or for detecting other substances.

Preferably, by means of the cartridge, at least one analyte (target analyte) of a sample can be determined, identified or detected. In particular, the sample can be tested for qualitatively or quantitatively determining at least one analyte, for example in order for it to be possible to detect or identify a disease and/or pathogen.

Within the meaning of the present invention, analytes are in particular nucleic-acid sequences, in particular DNA sequences and/or RNA sequences, or proteins, in particular antigens and/or antibodies. In particular, by means of the present invention, nucleic-acid sequences can be determined, identified or detected as analytes of a sample, or proteins can be determined, identified or detected as analytes of the sample. More particularly preferably, the present invention deals with systems, devices and other apparatus for carrying out a nucleic-acid assay for detecting or identifying a nucleic-acid sequence or a protein assay for detecting or identifying a protein.

The present invention deals in particular with what are known as point-of-care systems, i.e. in particular with mobile systems, devices and other apparatus, and deals with methods for carrying out tests on a sample at the sampling site and/or independently and/or away from a central laboratory or the like. Preferably, point-of-care systems can be operated autonomously and/or independently of a mains network for supplying electrical power.

DESCRIPTION OF RELATED ART

U.S. Pat. No. 5,096,669 discloses a point-of-care system for testing a biological sample, in particular a blood sample. The system comprises a single-use cartridge and an analysis device. Once the sample has been received, the cartridge is inserted into the analysis device in order to carry out the test. The cartridge comprises a microfluidic system and a sensor apparatus comprising electrodes, the apparatus being calibrated by means of a calibration liquid and then being used to test the sample.

Furthermore, International Patent Application Publication WO 2006/125767 A1 and corresponding U.S. Pat. No. 9,110,044 disclose a point-of-care system for integrated and automated DNA or protein analysis, comprising a single-use cartridge and an analysis device for fully automatically processing and evaluating molecular-diagnostic analyses using the single-use cartridge. The cartridge is designed to receive a sample, in particular blood, and in particular allows cell disruption, PCR and detection of PCR amplification products, which are bonded to capture molecules and provided with a label enzyme, in order for it to be possible to detect bonded PCR amplification products or nucleic-acid sequences as target analytes in what is known as a redox cycling process.

U.S. Patent Application Publication 2002/0127149 A1 discloses a microfluidic device with a body structure including at least two layers. The first layer comprises channels and chambers which are accessible through a plurality of ports disposed through the second layer. A further cover can be attached to the body structure, the cover having apertures which are aligned to the ports in the second layer of the body structure, thereby providing fluidic access to the channels and chambers.

German Utility Model DE 20 2006 020 469 U1 discloses a device for detection of molecules. The device comprises a connection for the supply of reagents, the connection comprising venting means.

U.S. Patent Application Publication 2015/0241319 A1 discloses a swab port device that interfaces a swab to a microfluidic device. The interior surface of a cavity that receives the swab has pointed protrusions for assisting a user in the removal of materials from inserted swabs.

A sample to be tested is usually received in the cartridge before the cartridge is inserted into an analysis device. The handling of the sample is not uncritical.

SUMMARY OF THE INVENTION

The problem addressed by the present invention is to provide a cartridge for testing a sample, good storage stability and/or simple handling and/or testing preferably being made possible or facilitated.

The above problem is solved by a cartridge as described herein.

The cartridge in particular comprises a main body comprising a plurality of cavities and/or channels that are covered by a cover. Preferably, a receiving cavity comprising a connection for receiving a sample to be tested and a closure element for fluidically closing the connection is provided.

According to one aspect of the present invention, the cover is preferably additionally covered and/or adhered or pasted over with an additional cover made of an inorganic material, in particular metal, particularly preferably aluminium, in the region of at least one storage cavity in order to cover or close said storage cavity in a particularly diffusion-resistant manner. As a result, the storage stability of a liquid reagent in the storage cavity can be increased in a very simple manner.

Particularly preferably, only after the cover has been applied, a film sheet is applied and/or adhesively bonded thereto as additional cover. This provides for simple and cost-effective production.

Simple and cost-effective production can be achieved in particular if a plastics film is used as the cover, the film being covered by the additional cover, and thus closed in a more diffusion-resistant manner, (only) in part, specifically in the region of one, a plurality of or all of the storage cavities.

According to another aspect of the present invention, which can also be implemented independently, the connection of the receiving cavity is provided with an integrated vent for venting the receiving cavity, preferably in a forced manner, when the sample is received. This provides for very simple handling. The integrated vent results in very simple handling since no undesired excess pressure can be produced in the receiving cavity during the filling process.

Particularly preferably, the connection is designed as a Luer port and/or as a conical opening and/or (bore-)hole and is provided with radial projections and/or depressions, and/or axial grooves or axial ribs, in order to provide a standard connection on the one hand, and/or to implement the integrated vent in a simple manner on the other hand.

Preferably, the closure element and/or the closure part thereof is preferably multi-component injection-moulded, in particular provided with an integrated seal. This is conducive to simple and cost-effective production. Moreover, good sealing is made possible or ensured. This is advantageous with regard to a reliable and defined test.

Preferably, the closure element preferably comprises a base part and a closure part, the closure part being movably and/or pivotally connected to the base part, in particular by means of a connecting part, and the base part being fastened to the cartridge or the main body of the cartridge, in particular in a form-fit or interlocking manner. This makes simple and cost-effective production possible. In particular, the closure element can be manufactured independently from the main body. This makes possible, in particular, optimised production and, for example, the use of a material that is different from that of the main body. Furthermore, very simple handling is ensured, because the closure element and/or the movable closure part is in particular captively connected to the main body, and thus to the cartridge, by means of the base part.

Preferably, the closure element or the base part thereof is fastened to the main body, in particular to the receiving cavity, in a non-removable or non-detachably manner and/or by means of latching or heat staking. This makes a compact and simple construction possible.

Particularly preferably, in the closed state, i.e. in the state in which it closes the connection of the receiving cavity, the closure part is held on or by the base part in a form-fit or interlocking manner, in particular by means of at least one retaining element or the like. Reliable securing or latching and/or mounting of the closure part in the closed state can be achieved in a very simple manner.

The term "cartridge" is preferably understood to mean a structural apparatus or unit designed to receive, to store, to physically, chemically and/or biologically treat and/or prepare and/or to measure a sample, preferably in order to make it possible to detect, identify or determine at least one analyte, in particular a protein and/or a nucleic-acid sequence, of the sample.

A cartridge within the meaning of the present invention preferably comprises a fluid system having a plurality of channels, cavities and/or valves for controlling the flow through the channels and/or cavities.

In particular, within the meaning of the present invention, a cartridge is designed to be at least substantially planar, flat and/or card-like, in particular is designed as a (micro)fluidic card and/or is designed as a main body or container that can preferably be closed and/or said cartridge can be inserted and/or plugged into a proposed analysis device when it contains the sample.

The above-mentioned aspects and features of the present invention and the aspects and features of the present invention that will become apparent from the claims and the following description can in principle be implemented independently from one another, but also in any combination or order.

Other aspects, advantages, features and properties of the present invention will become apparent from the following description of a preferred embodiment with reference to the accompanying drawings.

DETAILED DESCRIPTION OF THE INVENTION

In the figures, which are only schematic and sometimes not to scale, the same reference signs are used for the same or similar parts and components, corresponding or comparable properties and advantages being achieved even if these are not repeatedly described.

Figure 1:
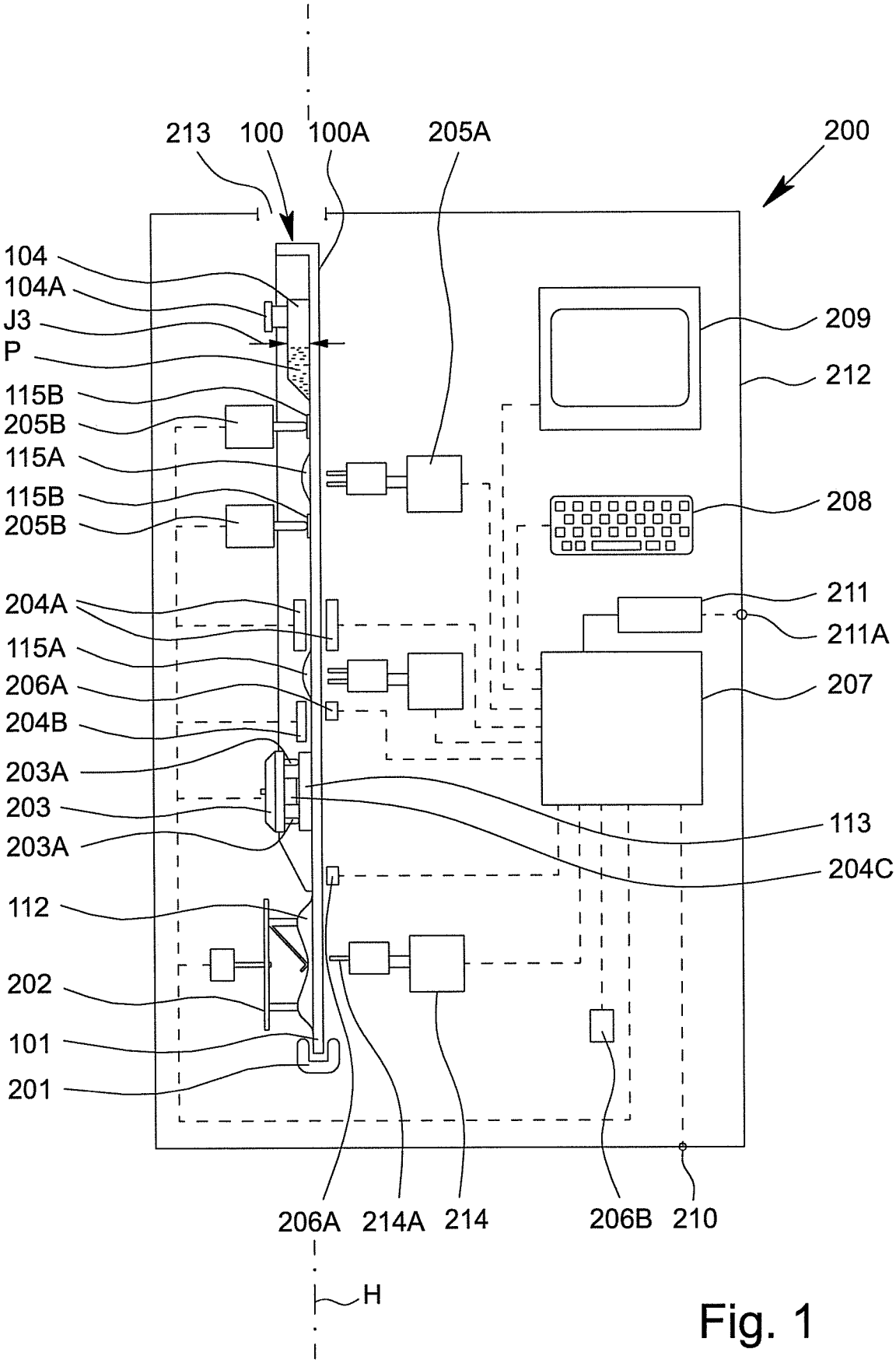
FIG. 1 is a schematic view of an analysis device and a proposed cartridge received in the analysis device.

FIG. 1 is a highly schematic view of a proposed apparatus or cartridge 100 in an analysis device 200 for testing an in particular biological sample P.

Figure 2:
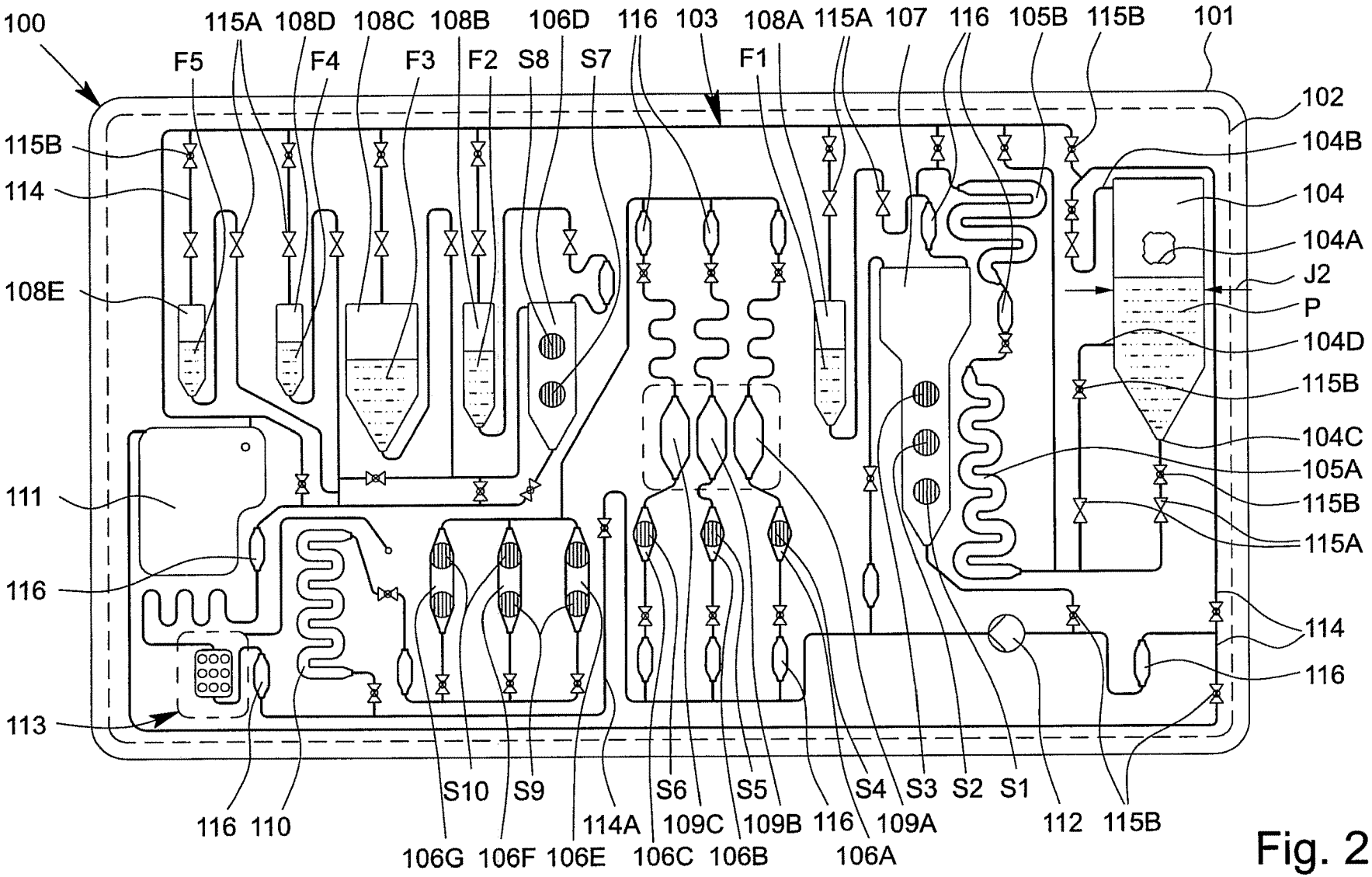
FIG. 2 is a schematic view of the cartridge.

FIG. 2 is a schematic view of a preferred embodiment of the proposed apparatus or cartridge 100 for testing the sample P. The apparatus or cartridge 100 in particular forms a handheld unit, and in the following is merely referred to as a cartridge 100.

The term "sample" is preferably understood to mean the sample material to be tested, which is in particular taken from a human or animal. In particular, within the meaning of the present invention, a sample is a fluid, such as saliva, blood, urine or another liquid, preferably from a human or animal, or a component thereof. Within the meaning of the present invention, a sample may be pretreated or prepared if necessary, or may come directly from a human or animal or the like, for example. A food sample, environmental sample or another sample may optionally also be tested, in particular for environmental analytics, food safety and/or for detecting other substances, preferably natural substances, but also biological or chemical warfare agents, poisons or the like.

A sample within the meaning of the present invention preferably contains one or more analytes, it preferably being possible for the analytes to be identified or detected, in particular qualitatively and/or quantitatively determined. Particularly preferably, within the meaning of the present invention, a sample has target nucleic-acid sequences as the analytes, in particular target DNA sequences and/or target RNA sequences, and/or target proteins as the analytes, in particular target antigens and/or target antibodies. Particularly preferably, at least one disease and/or pathogen can be detected or identified in the sample P by qualitatively and/or quantitatively determining the analytes.

Preferably, the analysis device 200 controls the testing of the sample P in particular in or on the cartridge 100 and/or is used to evaluate the testing and/or to collect, to process and/or to store measured values from the test.

By means of the analysis device 200 and/or by means of the cartridge 100 and/or using the method for testing the sample P, an analyte of the sample P, or particularly preferably a plurality of analytes of the sample P, can preferably be determined, identified or detected. Said analytes are in particular detected and/or measured not only qualitatively, but particularly preferably also quantitatively.

Therefore, the sample P can in particular be tested for qualitatively or quantitatively determining at least one analyte, for example in order for it to be possible to detect or identify a disease and/or pathogen or to determine other values, which are important for diagnostics, for example.

The cartridge 100 is preferably at least substantially planar, flat, plate-shaped and/or card-like.

The cartridge 100 preferably comprises an in particular at least substantially planar, flat, plate-shaped and/or card-like main body or support 101, the main body or support 101 in particular being made of and/or injection-moulded from plastics material, particularly preferably polypropylene.

The cartridge 100 preferably comprises at least one film or cover 102 for covering the main body 101 and/or cavities and/or channels formed therein at least in part, in particular on the front 100A, and/or for forming valves or the like, as shown by dashed lines in FIG. 2.

Particularly preferably, the cover 102 completely covers the cavities and/or channels on the front 100A and/or on a flat side of the cartridge 100. In particular, the cover 102 covers all of the cavities and/or channels on the front 100A and/or on a flat side of the cartridge 100.

The cartridge 100 and/or the main body 101 thereof, in particular together with the cover 102, preferably forms and/or comprises a fluidic system 103, referred to in the following as the fluid system 103.

The cartridge 100, the main body 101 and/or the fluid system 103 are preferably at least substantially vertically oriented in the operating position and/or during the test, in particular in the analysis device 200, as shown schematically in FIG. 1. In particular, the main plane H or surface extension of the cartridge 100 thus extends at least substantially vertically in the operating position.

The cartridge 100 and/or the fluid system 103 preferably comprises a plurality of cavities, in particular at least one receiving cavity 104, at least one metering cavity 105, at least one intermediate cavity 106, at least one mixing cavity 107, at least one storage cavity 108, at least one reaction cavity 109, at least one intermediate temperature-control cavity 110 and/or at least one collection cavity 111, the cavities preferably being fluidically interconnected by a plurality of channels.

Within the meaning of the present invention, channels are preferably elongate forms for conducting a fluid in a main flow direction, the forms preferably being closed transversely, in particular perpendicularly, to the main flow direction and/or longitudinal extension, preferably on all sides.

In particular, the main body 101 comprises elongate notches, recesses, depressions or the like, which are closed at the sides by the cover 102 and form channels within the meaning of the present invention.

Within the meaning of the present invention, cavities or chambers are preferably formed by recesses, depressions or the like in the cartridge 100 or main body 101, which are closed or covered by the cover 102, in particular at the sides. The volume or space enclosed by each cavity is preferably fluidically linked, in particular to the fluid system 103, by means of channels.

In particular, within the meaning of the present invention, a cavity comprises at least two openings for the inflow and/or outflow of fluids.

Within the meaning of the present invention, cavities preferably have a larger diameter and/or flow cross section than channels, preferably by at least a factor of 2, 3 or 4. In principle, however, cavities may in some cases also be elongate, in a similar manner to channels.

The cartridge 100 and/or the fluid system 103 also preferably comprises at least one pump apparatus 112 and/or at least one sensor arrangement or sensor apparatus 113.

In the example shown, the cartridge 100 or the fluid system 103 preferably comprises two metering cavities 105A and 105B, a plurality of intermediate cavities 106A to 106G, a plurality of storage cavities 108A to 108E and/or a plurality of reaction cavities 109, which can preferably be loaded separately from one another, in particular a first reaction cavity 109A, a second reaction cavity 109B and an optional third reaction cavity 109C, as can be seen in FIG. 2.

The metering cavities 105 are preferably designed to receive, to temporarily store and/or to meter the sample, and/or to pass on said sample in a metered manner. Particularly preferably, the metering cavities 105 have a diameter which is larger than that of the (adjacent) channels.

In the initial state of the cartridge or when at the factory, the storage cavities 108 are preferably filled at least in part, in particular with a liquid such as a reagent, solvent or wash buffer.

The collection cavity 111 is preferably designed to receive larger quantities of fluids that are in particular used for the test, such as sample residues or the like. Preferably, in the initial state or when at the factory, the collection cavity 111 is empty or filled with gas, in particular air. The volume of the collection cavity 111 corresponds to or exceeds preferably the (cumulative) volume of the storage cavity/cavities 108 or the liquid content thereof and/or the volume of the receiving cavity 104 or the sample P received.

The reaction cavity/cavities 109 is/are preferably designed to allow a substance located in the reaction cavity 109 to react when an assay is being carried out, for example by being linked or coupled to apparatus or modules of the analysis device 200.

The reaction cavity/cavities 109 is/are used in particular to carry out an amplification reaction, in particular PCR, or several, preferably different, amplification reactions, in particular PCRs. It is preferable to carry out several, preferably different, PCRs, i.e., PCRs having different primer combinations or primer pairs, in parallel and/or independently and/or in different reaction cavities 109.

"PCR" stands for polymerase chain reaction and is a molecular-biological method by means of which certain analytes, in particular portions of RNA or RNA sequences or DNA or DNA sequences, of a sample P are amplified, preferably in several cycles, using polymerases or enzymes, in particular in order to then test and/or detect the amplification products or nucleic-acid products. If RNA is intended to be tested and/or amplified, before the PCR is carried out, a cDNA is produced starting from the RNA, in particular using reverse transcriptase. The cDNA is used as a template for the subsequent PCR.

The amplification products, target nucleic-acid sequences and/or other portions of the sample P produced in the one or more reaction cavities 109 can be conducted or fed to the connected sensor arrangement or sensor apparatus 113, in particular by means of the pump apparatus 112.

The sensor arrangement or sensor apparatus 113 is used in particular for detecting, particularly preferably qualitatively and/or quantitatively determining, the analyte or analytes of the sample P, in this case particularly preferably the target nucleic-acid sequences and/or target proteins as the analytes. Alternatively, or additionally, however, other values may also be collected or determined.

The cartridge 100, the main body 101 and/or the fluid system 103 preferably comprise a plurality of channels 114 and/or valves 115, as shown in FIG. 2.

By means of the channels 114 and/or valves 115, the cavities 104 to 111, the pump apparatus 112 and/or the sensor arrangement or sensor apparatus 113 can be temporarily and/or permanently fluidically interconnected and/or fluidically separated from one another, as required and/or optionally or selectively, in particular such that they are controlled by the analysis device 200.

The cavities 104 to 111 are preferably each fluidically linked or interconnected by a plurality of channels 114. Particularly preferably, each cavity is linked or connected by at least two associated channels 114, in order to make it possible for fluid to fill, flow through and/or drain from the respective cavities as required.

The fluid transport or the fluid system 103 is preferably not based on capillary forces, or is not exclusively based on said forces, but in particular is essentially based on the effects of gravity and/or pumping forces and/or compressive forces and/or suction forces that arise, which are particularly preferably generated by the pump or pump apparatus 112. In this case, the flows of fluid or the fluid transport and the metering are controlled by accordingly opening and closing the valves 115 and/or by accordingly operating the pump or pump apparatus 112, in particular by means of a pump drive 202 of the analysis device 200.

Preferably, each of the cavities 104 to 110 has an inlet at the top and an outlet at the bottom in the operating position. Therefore, if required, only liquid from the respective cavities can be removed via the outlet.

In the operating position, the liquids from the respective cavities are preferably removed, in particular drawn out, via the outlet that is at the bottom in each case, it preferably being possible for gas or air to flow and/or be pumped into the respective cavities via the inlet that is in particular at the top. In particular, relevant vacuums in the cavities can thus be prevented or at least minimised when conveying the liquids.

In particular, the cavities, particularly preferably the storage cavity/cavities 108, the mixing cavity 107 and/or the receiving cavity 104, are each dimensioned and/or oriented in the normal operating position such that, when said cavities are filled with liquid, bubbles of gas or air that may potentially form rise upwards in the operating position, such that the liquid collects above the outlet without bubbles. However, other solutions are also possible here.

The receiving cavity 104 preferably comprises a connection 104A for introducing the sample P. In particular, the sample P may for example be introduced into the receiving cavity 104 and/or cartridge 100 via the connection 104A by means of a pipette, syringe or other instrument.

The receiving cavity 104 preferably comprises an inlet 104B, an outlet 104C and an optional intermediate connection 104D, it preferably being possible for the sample P or a portion thereof to be removed and/or conveyed further via the outlet 104C and/or the optional intermediate connection 104D. Gas, air or another fluid can flow in and/or be pumped in via the inlet 104B, as already explained.

Preferably, the sample P or a portion thereof can be removed, optionally and/or depending on the assay to be carried out, via the outlet 104C or the optional intermediate connection 104D of the receiving cavity 104. In particular, a supernatant of the sample P, such as blood plasma or blood serum, can be discharged or removed via the optional intermediate connection 104D, in particular for carrying out the protein assay.

Preferably, at least one valve 115 is assigned to each cavity, the pump apparatus 112 and/or the sensor apparatus 113 and/or is arranged upstream of the respective inlets and/or downstream of the respective outlets.

Preferably, the cavities 104 to 111 or sequences of cavities 104 to 111, through which fluid flows in series or in succession for example, can be selectively released and/or fluid can selectively flow therethrough by the assigned valves 115 being actuated, and/or said cavities can be fluidically connected to the fluid system 103 and/or to other cavities.

In particular, the valves 115 are formed by the main body 101 and the film or cover 102 and/or are formed therewith and/or are formed in another manner, for example by or having additional layers, depressions or the like.

Particularly preferably, one or more valves 115A are provided which are preferably tightly closed initially or when in storage, particularly preferably in order to seal liquids or liquid reagents F, located in the storage cavities 108, and/or the fluid system 103 from the open receiving cavity 104 in a storage-stable manner.

Preferably, an initially closed valve 115A is arranged upstream and downstream of each storage cavity 108. Said valves are preferably only opened, in particular automatically, when the cartridge 100 is actually being used and/or during or after inserting the cartridge 100 into the analysis device 200 and/or for carrying out the assay.

A plurality of valves 115A, in particular three valves in this case, are preferably assigned to the receiving cavity 104, in particular if the intermediate connection 104D is provided in addition to the inlet 104B and the outlet 104C. Depending on the use, in addition to the valve 115A on the inlet 104B, then preferably only the valve 115A either at the outlet 104C or at the intermediate connection 104D is opened.

The valves 115A assigned to the receiving cavity 104 seal the fluid system 103 and/or the cartridge 100 in particular fluidically and/or in a gas-tight manner, preferably until the sample P is inserted and/or the receiving cavity 104 or the connection 104A of the receiving cavity 104 is closed.

As an alternative or in addition to the valves 115A (which are initially closed), one or more valves 115B are preferably provided which are not closed in a storage-stable manner and/or which are open initially or in an inoperative position, in an initial state or when the cartridge 100 is not inserted into the analysis device 200, and/or which can be closed by actuation. These valves 115B are used in particular to control the flows of fluid during the test.

The cartridge 100 is preferably designed as a microfluidic card and/or the fluid system 103 is preferably designed as a microfluidic system. In the present invention, the term "microfluidic" is preferably understood to mean that the respective volumes of individual cavities, some of the cavities or all of the cavities 104 to 111 and/or channels 114 are, separately or cumulatively, less than 5 ml or 2 ml, particularly preferably less than 1 ml or 800 μl, in particular less than 600 μl or 300 μl, more particularly preferably less than 200 μl or 100 μl.

Particularly preferably, a sample P having a maximum volume of 5 ml, 2 ml or 1 ml can be introduced into the cartridge 100 and/or the fluid system 103, in particular the receiving cavity 104.

Reagents and liquids which are preferably introduced or provided before the test in liquid form as liquids or liquid reagents F and/or in dry form as dry reagents S are required for testing the sample P, as shown in the schematic view according to FIG. 2 by reference signs F1 to F5 and S1 to S10.

Furthermore, other liquids F, in particular in the form of a wash buffer, solvent for dry reagents S and/or a substrate, for example in order to form detection molecules D and/or a redox system, are also preferably required for the test, the detection process and/or for other purposes, and are in particular provided in the cartridge 100, i.e. are likewise introduced before use, in particular before delivery. At some points in the following, a distinction is not made between liquid reagents and other liquids, and therefore the respective explanations are accordingly also mutually applicable.

The cartridge 100 preferably contains all the reagents and liquids required for pretreating the sample P and/or for carrying out the test or assay, in particular for carrying out one or more amplification reactions or PCRs, and therefore, particularly preferably, it is only necessary to receive the optionally pre-treated sample P.

The cartridge 100 or the fluid system 103 preferably comprises a bypass 114A that can optionally be used, in order for it to be possible, if necessary, to conduct or convey the sample P or components thereof past the reaction cavities 109 and/or, by bypassing the optional intermediate temperature-control cavity 110, also directly to the sensor apparatus 113.

The cartridge 100, the fluid system 103 and/or the channels 114 preferably comprise sensor portions 116 or other apparatus for detecting liquid fronts and/or flows of fluid.

It is noted that various components, such as the channels 114, the valves 115, in particular the valves 115A that are initially closed and the valves 115B that are initially open, and the sensor portions 116 in FIG. 2 are, for reasons of clarity, only labelled in some cases, but the same symbols are used in FIG. 2 for each of these components.

The collection cavity 111 is preferably used for receiving excess or used reagents and liquids and volumes of the sample, and/or for providing gas or air in order to empty individual cavities and/or channels. In the initial state, the collection cavity 111 is preferably filled solely with gas, in particular air.

In particular, the collection cavity 111 can optionally be connected to individual cavities and channels 114 or other apparatus fluidically in order to remove reagents and liquids from said cavities, channels or other apparatus and/or to replace said reagents and liquids with gas or air. The collection cavity 111 is preferably given appropriate large dimensions.

Figure 3:
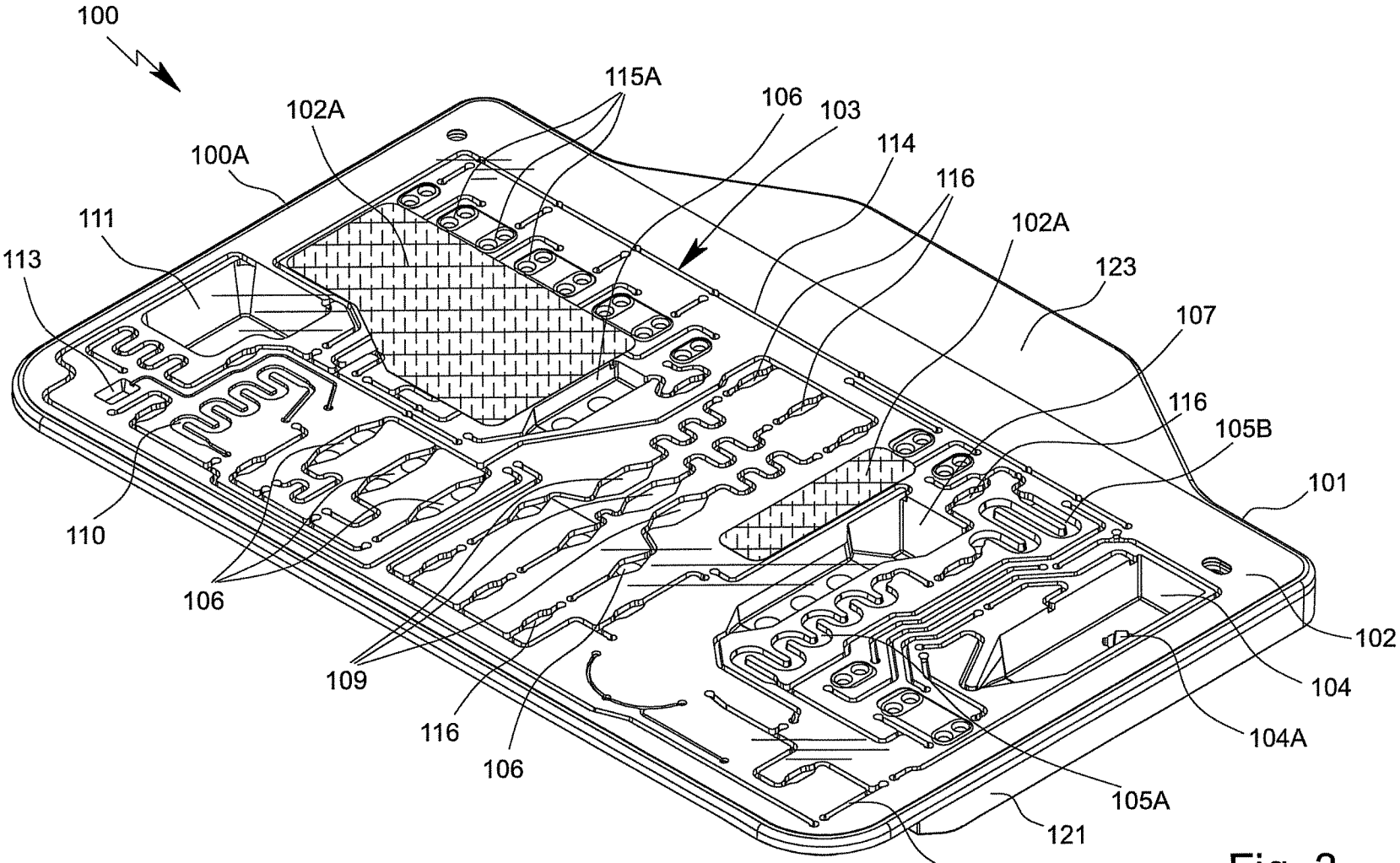
FIG. 3 is a schematic perspective front view of the cartridge.
Figure 4:
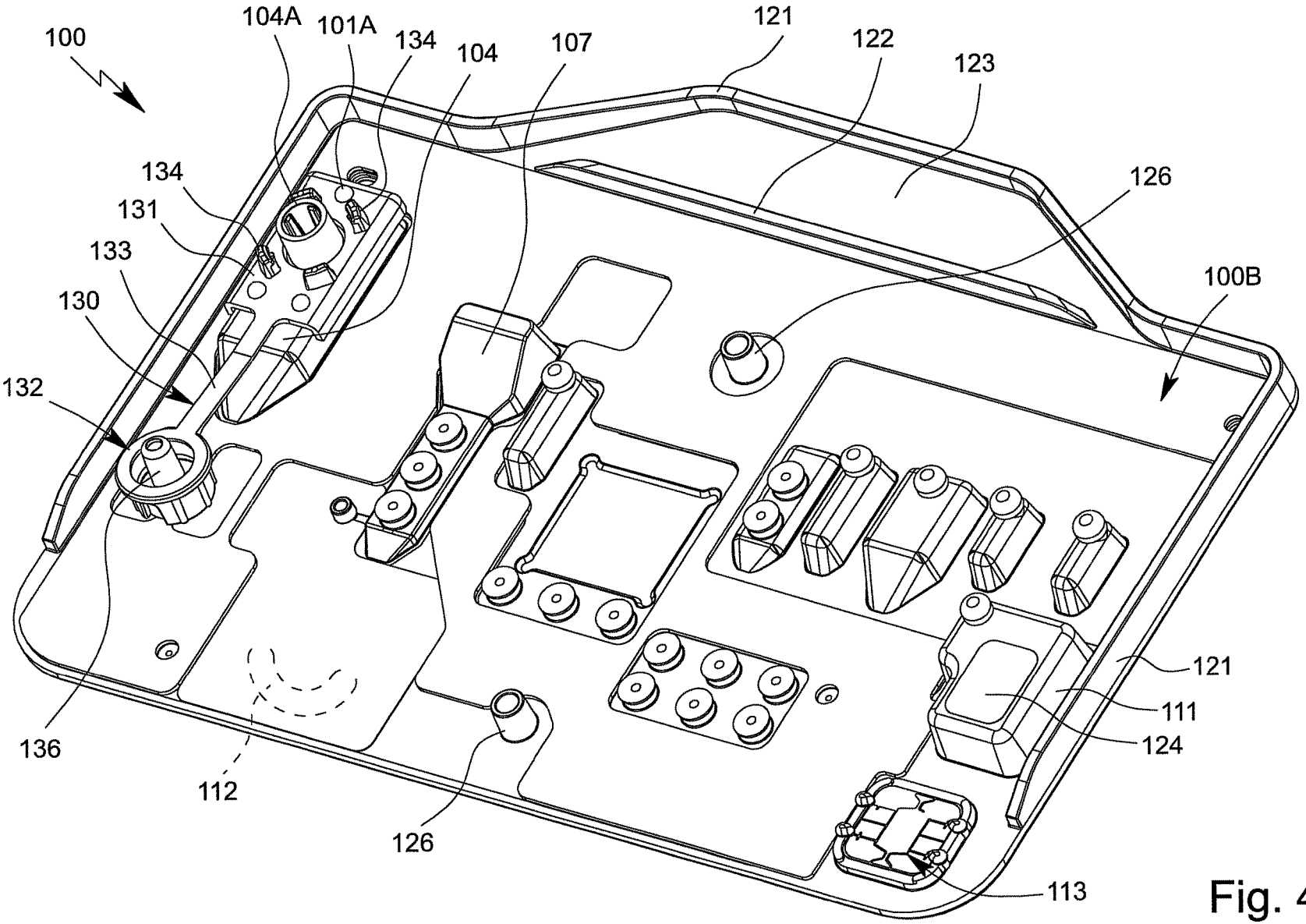
FIG. 4 is a schematic perspective rear view of the cartridge comprising a receiving cavity.

FIG. 3 is a perspective front view of the cartridge 100, i.e. of the front 100A thereof, and FIG. 4 is a perspective rear view of the cartridge 100, i.e. of the back 100B thereof.

In order to achieve particularly good storage stability of the liquid reagent(s) F, the cover 102 is preferably produced from or additionally covered by an inorganic material, in particular metal, particularly preferably aluminium, preferably in the region of at least one storage cavity 108. This is preferably achieved by applying or adhesively bonding a piece of material or film sheet, consisting of or produced from the corresponding material, as an additional cover 102A in the region of the respective storage cavities 108, as shown schematically in FIG. 3.

This provides for very simple production, since the (substantially) continuous film or plastics film can first be applied as a cover 102 and the additional cover 102A (consisting at least in part of the inorganic material or metal) only then is applied or adhesively bonded, in the desired region, to the film or cover 102 located below the additional cover 102A.

The corresponding storage cavity 108 can thus be very easily covered and/or closed in a particularly diffusion-resistant manner.

In the example shown, for example an additional cover 102A is assigned, in the region to the right of the centre, to just one storage cavity, in this case the storage cavity 108A, in order to cover said storage cavity. On the left-hand side in FIG. 3, a larger piece of material, as the additional cover 102A, preferably covers the entirety of a plurality of storage cavities 108, in this case the storage cavities 108B-108E.

The additional cover 102A thus preferably does not cover the cover 102 completely, but only in part, in particular only in the region of one or more storage cavities 108.

The additional cover 102A is in each case preferably connected and/or adhesively bonded, over its entire surface, to the cover 102 located therebelow.

In principle, it is also possible to apply the additional cover 102A in another manner, for example by coating and/or by lamination, adhesion or the like.

Accordingly, significantly improved storage stability of the liquid reagents F located in the storage cavities 108 can be achieved in a simple manner.

In the example shown, the additional cover 102A is applied and/or adhesively bonded only after the (continuous) cover 102 has been applied. The additional cover 102A is therefore arranged in each case on the side of the cover 102 remote from the main body 101.

However, the additional cover 102A can alternatively also be applied first to the main body 101 and then covered by the continuous cover 102. This results in comparable advantages.

The cartridge 100 and/or the main body 101 preferably comprises a reinforced or angled edge 121 and/or a reinforcing rib 122, particularly preferably on the back 100B, as shown schematically in FIG. 4.

The cartridge 100 and/or the main body 101 preferably comprises a grip portion 123 in order for it to be possible to optimally grip and/or hold the cartridge 100 by hand. The grip portion 123 is in particular arranged and/or formed or integrally moulded on a longitudinal side.

Particularly preferably, the grip portion 123 extends in the plate plane or main plane H of the cartridge 100 or main body 101. In the example shown, the grip portion 123 is particularly preferably substantially trapezoidal. However, other shapes are also possible.

The edge 121 and/or the reinforcing rib 122 preferably projects/project transversely from the plate plane or main plane H and/or the back 100B of the cartridge 100 or main body 101.

In the example shown, the edge 121 preferably extends along the two narrow sides and/or along a longitudinal side and/or the grip portion 123 of the cartridge 100 or main body 101, substantially on the outside.

The reinforcing rib 122 preferably extends between the grip portion 123 and the remaining, particularly preferably substantially rectangular, part of the cartridge 100 or main body 101.

The reinforcing rib 122 thus extends at least substantially along a longitudinal side of the preferably at least substantially rectangular basic shape of the cartridge 100.

The edge 121 and/or the reinforcing rib 122 are used in particular to provide reinforcement for the cartridge 100 or the main body 101 transversely to the surface extension or plate plane or flat side or back 100B. This is particularly advantageous for making it possible to mount or clamp the cartridge 100 in the analysis device 200 in as defined a manner as possible. The increased rigidity makes it possible, for example, for the sensor arrangement or sensor apparatus 113 to be contacted in a simple or more defined manner and/or improves the effect on the pump apparatus 112.

The edge 121, the reinforcing rib 122 and/or the grip portion 123 is/are preferably formed in one piece with the main body 101, in particular integrally moulded thereon.

The cartridge 100 preferably comprises an in particular optically readable identifier, such as a barcode 124, in this case in particular on the back 100B and/or on the collection cavity 111 and/or adhesively bonded thereon.

The cartridge 100 or the main body 101 preferably comprises at least one positioning portion 126, in particular two positioning portions 126 in the example shown, for mounting and/or positioning the cartridge 100 in a defined manner, in particular in the analysis device 200 while a sample P is being tested, as shown in FIG. 4.

The positioning portion 126 is in particular integrally moulded on or formed in one piece with the main body 101.

The positioning portion 126 preferably projects from a flat side, in this case the back 100B, or the plate plane of the cartridge 100 or main body 101.

The positioning portion 126 is in particular cylindrical or hollow cylindrical and/or conical, preferably on the inside and/or outside.

The outside of the positioning portion 126 preferably tapers towards the free end or is conical. This is conducive to simple production and/or centring of the cartridge 100 in the analysis device 200.

The inside of the positioning portion 126 is preferably conical or widens towards the free end. This is conducive to simple production and/or centring of the cartridge 100 in the analysis device 200.

The two positioning portions 126 are preferably arranged in a line that is parallel to a side of the cartridge 100, in particular in a central line that is transverse to a longitudinal side of the cartridge 100.

In particular, in the view according to FIG. 4, one positioning portion 126 is arranged in the region of the lower longitudinal side of the cartridge 100. The other positioning portion 126 is arranged in particular in the vicinity of the optional reinforcing rib 122.

The connection 104A of the receiving cavity 104 can be closed after the sample P has been received. The cartridge 100 preferably comprises a closure element 130 for this purpose.

In particular, the connection 104A can be closed in a liquid-tight and particularly preferably also gas-tight manner by the closure element 130. In particular, a closed fluid circuit can thus be formed, with the receiving cavity 104 being included. In particular, once the assigned valves 115A at the inlet 104B, outlet 104C and/or intermediate connection 104D have been opened, the receiving cavity 104 thus forms part of the fluid system 103 of the cartridge 100, wherein the fluid system is preferably closed or can be closed by the closure element 130.

The closure element 130 or the closure part 132 thereof closes the receiving cavity 104 or the connection 104A thereof preferably in a permanent manner, i.e. it preferably cannot be released again. The connection 104A therefore preferably cannot be reopened after it has been closed.

In the example shown, the closure element 130 preferably comprises a base part 131 and the closure part 132, the closure part 132 being movably and/or pivotally connected to the base part 131 in particular by means of a connecting part 133 that is preferably formed bar-like in this case.

Preferably, the base part 131, the connecting part 133 and the closure part 132 are formed in one piece, in particular formed as an injection-moulded part and/or produced from plastics material.

Figure 5:
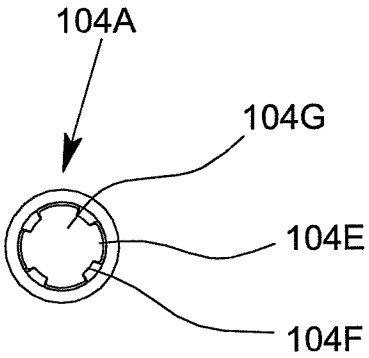
FIG. 5 is a schematic plan view of a connection of the receiving cavity.

FIG. 5 is a schematic plan view of the connection 104A of the receiving cavity 104. Preferably, the connection 104A, which is in particular substantially designed as a so-called Luer connection or Luer port or as a conical hole or receiving opening 104G, comprises an integrated vent 104E which is in particular formed by corresponding axial grooves in the inner wall of the connection 104 or the opening 104G therein, or by axially extending ridges or by inwardly protruding projections 104F, as shown in FIG. 5.

The opening 104G preferably extends or is arranged transversely, in particular perpendicularly, to the main plane H and/or protrudes from the main body 101 transversely, in particular perpendicularly, to the main plane H.

Figure 6:
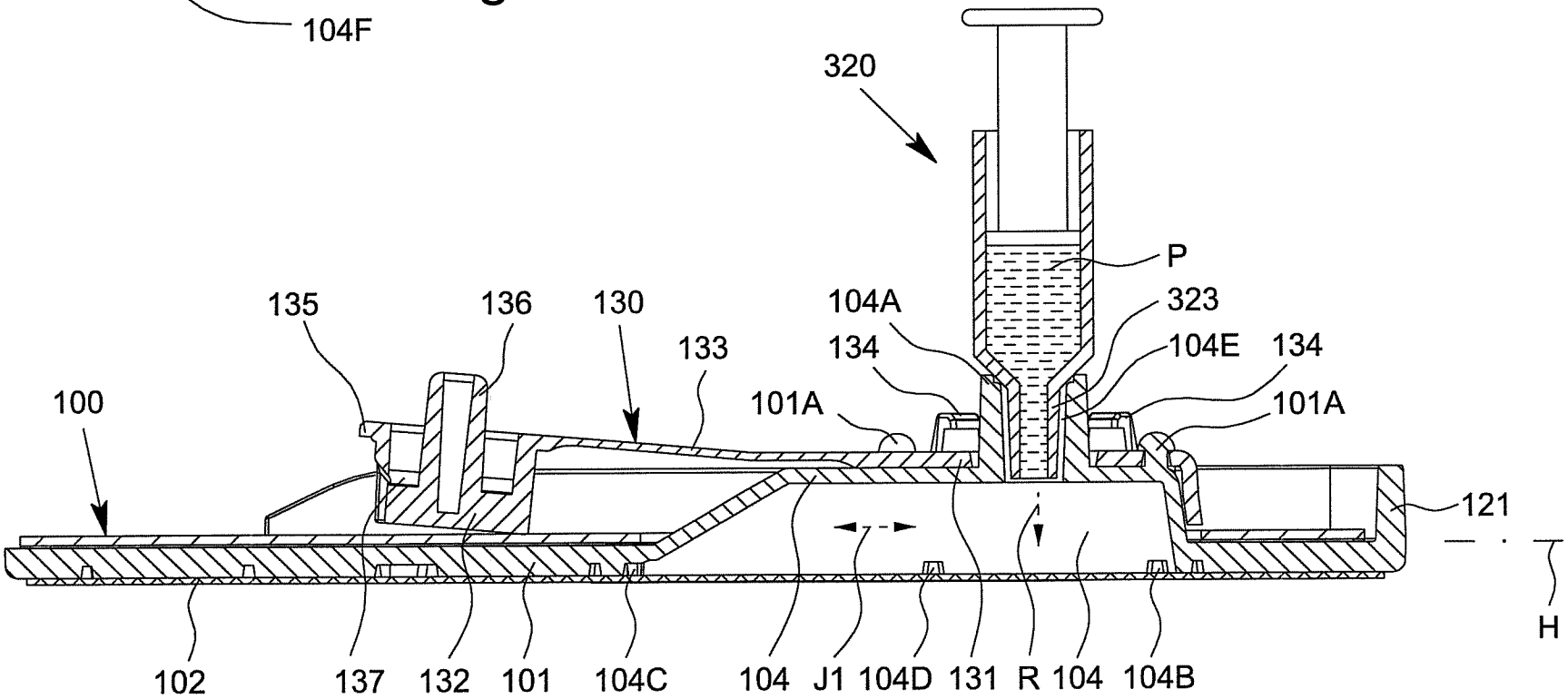
FIG. 6 is a schematic sectional detail of the cartridge while it is being filled with a sample.

FIG. 6 is a highly schematic sectional detail of the cartridge 100 or the receiving cavity 104 being filled, by means of a transfer apparatus 320, with the sample P to be tested. The transfer apparatus 320 is preferably formed in the manner of a syringe. However, other structural solutions are also possible.

The transfer apparatus 320 is preferably connected to and/or plugged into the connection 104A by means of a connection 323, in particular a connecting tip, particularly preferably in such a way that the vent 104E or the grooves formed thereby remain open so that, when the receiving cavity 104 is filled (in part) with the sample P, gas or air can escape from the receiving cavity 104 to the outside through the vent 104E. In this regard it is noted that, in the delivery state, the valves 115A assigned to the receiving cavity 104 are all closed, and the fluid system 103 is thus closed off from the receiving cavity 104 such that displaced air can escape only through the connection 104A and/or the vent 104E that is particularly preferably provided. However, other structural solutions are in principle also possible.

FIG. 6 shows the cartridge 100 together with the connected transfer apparatus 320, but before the receiving cavity 104 is actually filled with the sample P or before said sample is actually fed to said cavity.

The main direction R when filling the cartridge with the sample P is shown schematically in FIG. 6. This main direction R extends in the opposite direction from the main opening direction of the connection 104A.

The main direction R preferably extends transversely and/or perpendicularly to a longitudinal extension J1 of the receiving cavity 104 and/or the main plane H of the cartridge 100, as shown schematically in FIG. 6.

Specifically, the receiving cavity 104 is designed such that the longitudinal extension J1 thereof extends at least substantially in the vertical direction in the operating position of the cartridge 100.

Specifically, as already explained, the plate plane or main plane H of the cartridge 100, as shown in FIGS. 1 and 6, is oriented at least substantially vertically during use.

Preferably, the receiving cavity 104 is filled with the sample P when the plate plane or main plane H of the cartridge 100 is oriented at least substantially horizontally, as shown in FIG. 6, and, after the connection 104A has been closed, the test is carried out or can be carried out on the received sample P, in this case in particular in the analysis device 200, when the plane H of the cartridge 100 is oriented at least substantially vertically. This at least substantially vertical orientation is therefore the operating position of the cartridge 100 during the test.

Preferably, in the operating position of the cartridge 100, the intermediate connection 104D is arranged so as to be higher than the outlet 104C and/or lower than the inlet 104B and/or lower than the connection 104A, as can be seen in FIG. 6 (if FIG. 6 is rotated anti-clockwise by 90°).

In the operating position, if necessary a supernatant of the sample P, such as blood serum from a blood sample, can be discharged or carried away via the intermediate connection 104D.

Preferably, the width J2 (shown in FIG. 2) and/or the depth J3 (shown in FIG. 1) of the receiving cavity 104 tapers towards the outlet 104C. This is conducive to effectively discharging the sample P in the operating position.

As already explained, one initially closed valve 115A that is closed in the delivery state of the cartridge 100 is respectively assigned to each of the inlet 104B, the outlet 104C and, if it is provided, the optional intermediate connection 104D. These valves 115A are only opened by the analysis device 200 later, as required. This ensures that the sample P cannot flow into or flow away in other channels or cavities in an undesired or undefined manner following the filling process or during the filling process.

After the receiving cavity 104 has been filled with the sample P, the transfer apparatus 320 is removed and the connection 104A is closed by the closure element 130 and/or the closure part 132 thereof being placed onto the connection 104A in order to sealingly or tightly close said connection.

In the closed state, the closure element 130 or the closure part 132 thereof is preferably sealingly or tightly held against or on the connection 104A in a latching or form-fit or interlocking manner, in the example shown in particular by means of one or more retaining arms or elements 134 which are in particular arm-like and/or which comprise or form one or more latching projections, as shown schematically in FIGS. 4 and 6.

In particular, the retaining elements 134 are arranged and/or integrally moulded on the closure element 130 or on the base part 131.

The retaining elements 134 are preferably arranged around the connection 104A and/or surround, encompass or extend over the closure part 132 and/or a projection, edge or collar 135 (FIG. 6) of the closure part 132 in the closed state. However, other structural solutions are also possible.

During the closing process and/or in the closed state, a guide projection 136 of the closure element 130 and/or the closure part 132 preferably engages in the connection 104A and/or the opening 104G (FIG. 5) therein.

Preferably, the closure element 130 and/or the closure part 132 thereof comprises an integrated seal 137, as also shown in FIG. 6. The seal 137 is in particular integrated and/or injected or injection-moulded into an annular groove in the closure part 132.

Particularly preferably, the closure element 130 and/or the closure part 132 thereof, as well as the seal 137, are multi-component injection-moulded, i.e. produced in particular in a two-step injection process in the same injection mould. However, other structural solutions are also possible.

Particularly preferably, the closure element 130 and/or the base part 131 thereof is fastened to the cartridge 100 and/or the main body 101 thereof in a latching and/or form-fit or interlocking manner.

In the example shown, the base part 131 is preferably arranged on and/or fastened to the receiving cavity 104. In particular, the base part 131 is latched thereto or otherwise connected thereto in a form-fit or interlocking or bonded manner, for example by welding, heat staking, adhesion or the like.

Preferably, the base part 131 is held and/or fastened by means of at least one retaining portion 101A, in the example shown even by means of a plurality of retaining portions 101A, arranged or integrally moulded on the main body 101, the retaining portions 101A in particular passing through recesses in the base part 131 and/or being heat staked or deformed at the free end such that the base part 131 is secured to the main body 101 and/or the receiving cavity 104 in a form-fit or interlocking manner, as shown in FIG. 6. However, other structural solutions are also possible.

Once the sample P has been introduced into the receiving cavity 104 and the connection 104A has been closed, the cartridge 100 can be inserted into and/or received in the proposed analysis device 200 in order to test the sample P, as shown in FIG. 1.

The analysis device 200 preferably comprises a mount or receptacle 201 for mounting and/or receiving the cartridge 100.

Preferably, the cartridge 100 is fluidically, in particular hydraulically, separated or isolated from the analysis device 200. In particular, the cartridge 100 forms a preferably independent and in particular closed or sealed fluidic or hydraulic system 103 for the sample P and the reagents and other liquids. In this way, the analysis device 200 does not come into direct contact with the sample P and can in particular be reused for another test without being disinfected and/or cleaned first.

It is however provided that the analysis device 200 is connected or coupled mechanically, electrically, thermally and/or pneumatically to the cartridge 100.

In particular, the analysis device 200 is designed to have a mechanical effect, in particular for actuating the pump apparatus 112 and/or the valves 115, and/or to have a thermal effect, in particular for temperature-controlling the reaction cavity/cavities 109 and/or the intermediate temperature-control cavity 110.

In addition, the analysis device 200 can preferably be pneumatically connected to the cartridge 100, in particular in order to actuate individual apparatus, and/or can be electrically connected to the cartridge 100, in particular in order to collect and/or transmit measured values, for example from the sensor apparatus 113 and/or sensor portions 116.

The analysis device 200 preferably comprises a pump drive 202, the pump drive 202 in particular being designed for mechanically actuating the pump apparatus 112.

The analysis device 200 preferably comprises a connection apparatus 203 for in particular electrically and/or thermally connecting the cartridge 100 and/or the sensor arrangement or sensor apparatus 113.

As shown in FIG. 1, the connection apparatus 203 preferably comprises a plurality of electrical contact elements 203A, the cartridge 100, in particular the sensor arrangement or sensor apparatus 113, preferably being electrically connected or connectable to the analysis device 200 by the contact elements 203A.

The analysis device 200 preferably comprises one or more temperature-control apparatus 204 for temperature-controlling the cartridge 100 and/or having a thermal effect on the cartridge 100, in particular for heating and/or cooling, the temperature-control apparatus(es) 204 (each) preferably comprising or being formed by a heating resistor or a Peltier element.

Preferably, individual temperature-control apparatus 204, some of these apparatus or all of these apparatus can be positioned against the cartridge 100, the main body 101, the cover 102, the sensor arrangement, sensor apparatus 113 and/or individual cavities and/or can be thermally coupled thereto and/or can be integrated therein and/or can be operated or controlled in particular electrically by the analysis device 200. In the example shown, in particular the temperature-control apparatus 204A, 204B and/or 204C are provided.

The analysis device 200 preferably comprises one or more actuators 205 for actuating the valves 115. Particularly preferably, different (types or groups of) actuators 205A and 205B are provided which are assigned to the different (types or groups of) valves 115A and 115B for actuating each of said valves, respectively.

The analysis device 200 preferably comprises one or more sensors 206. In particular, sensors 206A are assigned to the sensor portions 116 and/or are designed or intended to detect liquid fronts and/or flows of fluid in the fluid system 103.

Particularly preferably, the sensors 206A are designed to measure or detect, in particular in a contact-free manner, for example optically and/or capacitively, a liquid front, flow of fluid and/or the presence, the speed, the mass flow rate/volume flow rate, the temperature and/or another value of a fluid in a channel and/or a cavity, in particular in a respectively assigned sensor portion 116, which is in particular formed by a planar and/or widened channel portion of the fluid system 103.

Alternatively, or additionally, the analysis device 200 preferably comprises (other or additional) sensors 206B for detecting the ambient temperature, internal temperature, atmospheric humidity, position, and/or alignment, for example by means of a GPS sensor, and/or the orientation and/or inclination of the analysis device 200 and/or the cartridge 100.

The analysis device 200 preferably comprises a control apparatus 207, in particular comprising an internal clock or time base for controlling the sequence of a test or assay and/or for collecting, evaluating and/or outputting or providing measured values in particular from the sensor apparatus 113, and/or from test results and/or other data or values.

The control apparatus 207 preferably controls or feedback controls the pump drive 202, the temperature-control apparatus 204 and/or actuators 205, in particular taking into account or depending on the desired test and/or measured values from the sensor arrangement or sensor apparatus 113 and/or sensors 206.

Optionally, the analysis device 200 comprises an input apparatus 208, such as a keyboard, a touch screen or the like, and/or a display apparatus 209, such as a screen.

The analysis device 200 preferably comprises at least one interface 210, for example for controlling, for communicating and/or for outputting measured data or test results and/or for linking to other devices, such as a printer, an external power supply or the like. This may in particular be a wired or wireless interface 210.

The analysis device 200 preferably comprises a power supply 211 for providing electrical power, preferably a battery or an accumulator, which is in particular integrated and/or externally connected or connectable.

Preferably, an integrated accumulator is provided as a power supply 211 and is (re)charged by an external charging device (not shown) via a connection 211A and/or is interchangeable.

The analysis device 200 preferably comprises a housing 212, all the components and/or some or all of the apparatus preferably being integrated in the housing 212. Particularly preferably, the cartridge 100 can be inserted or slid into the housing 212, and/or can be received by the analysis device 200, through an opening 213 which can in particular be closed, such as a slot or the like.

The analysis device 200 is preferably portable or mobile. Particularly preferably, the analysis device 200 weighs less than 25 kg or 20 kg, particularly preferably less than 15 kg or 10 kg, in particular less than 9 kg or 6 kg.

As already explained, the analysis device 200 can preferably be pneumatically linked to the cartridge 100, in particular to the sensor arrangement or sensor apparatus 113 and/or to the pump apparatus 112.

Particularly preferably, the analysis device 200 is designed to supply the cartridge 100, in particular the sensor arrangement or sensor apparatus 113 and/or the pump apparatus 112, with a working medium, in particular gas or air.

Preferably, the working medium can be compressed and/or pressurized in the analysis device 200 or by means of the analysis device 200.

Preferably, the analysis device 200 comprises a pressurized gas supply 214, in particular a pressure generator or compressor, preferably in order to compress, condense and/or pressurise the working medium.

The pressurized gas supply 214 is preferably integrated in the analysis device 200 or the housing 212 and/or can be controlled or feedback controlled by means of the control apparatus 207.

Preferably, the pressurized gas supply 214 is electrically operated or can be operated by electrical power. In particular, the pressurized gas supply 214 can be supplied with electrical power by means of the power supply 211.

Preferably, air can be drawn in, in particular from the surroundings, as the working medium by means of the analysis device 200 or pressurized gas supply 214. In particular, the analysis device 200 or pressurized gas supply 214 is designed to use the surroundings as a reservoir for the working medium or the air. However, other solutions are also possible here, in particular those in which the analysis device 200 or pressurized gas supply 214 comprises a preferably closed or delimited reservoir, such as a tank or container, comprising the working medium, and/or is connected or connectable thereto.

The analysis device 200 or pressurized gas supply 214 preferably comprises a connection element 214A, in particular in order to pneumatically connect the analysis device 200 or pressurized gas supply 214 to the cartridge 100.

In particular, the present invention relates also to any one of the following aspects which can be realized independently or in any combination, also in combination with any aspects described above.

Cartridge (100) for testing an in particular biological sample (P), the cartridge (100) comprising a main body (101) having a plurality of channels (114) and cavities (104-111), and the cartridge (101) comprising a cover (102) for the channels (114) and cavities (104-111), characterised in that the cover 102 is additionally covered and/or adhered over with an additional cover 102A made of an inorganic material in the region of a storage cavity 108 in order to cover and/or close said storage cavity 108 in a particularly diffusion-resistant manner, and/or in that the cartridge 100 comprises a receiving cavity 104 comprising a connection 104A for receiving the sample P and a closure element 130 for fluidically closing the connection 104A, the connection 104A comprising an integrated vent 104E for venting the receiving cavity 104 when the sample P is received.

Individual aspects and features of the present invention and individual method steps and/or method variants may be implemented independently from one another, but also in any desired combination and/or order.

What is claimed is:

1. Cartridge for testing a biological sample and which is receivable in an analysis device, comprising:
- a main body having a plurality of channels and cavities, and
- a cover for the channels and cavities,
- wherein the said cavities comprise a receiving cavity having a connection for receiving the sample,
- wherein a closure element is provided for fluidically closing the connection,
- wherein the connection comprises an integrated vent for venting the receiving cavity when the sample is received, and
- wherein the receiving cavity comprises an inlet and an outlet, in addition to the connection, and
- further comprising a valve that is closed in a delivery state of the cartridge, a respective said valve being associated with each of the inlet and the outlet of the receiving cavity, each valve being adapted for only being opened by the analysis device.

2. Cartridge according to claim 1, wherein the receiving cavity comprises an intermediate connection, in addition to the connection and the inlet and the outlet.

3. Cartridge according to claim 2, wherein the intermediate connection is arranged higher than the outlet and lower than the inlet and branching off from the receiving cavity to enable a supernatant of the sample to be discharged in an operating position of the cartridge.

4. Cartridge according to claim 1, wherein the receiving cavity tapers towards an outlet thereof.

5. Cartridge according to claim 1, wherein a main opening direction of the connection extends transversely or perpendicularly to a longitudinal extension of the receiving cavity.

6. Cartridge according to claim 1, wherein an opening of the connection extends transversely to a main plane of the cartridge.

7. Cartridge according to claim 1, wherein the connection is one of a Luer port and a conical hole or opening.

8. Cartridge according to claim 1, wherein the connection comprises an opening having at least one inner projection for forming the vent.

9. Cartridge according to claim 1, wherein the closure element comprises a base part and a closure part, the closure part being movably connected to the base part by means of a connecting part, and wherein the base part is fastened to the main body in a form-fit or interlocking manner.

10. Cartridge according to claim 1, wherein the closure element comprises an integrated seal.

11. Cartridge according to claim 1, wherein the closure element is formed in one piece.

12. Cartridge according to claim 1, wherein in a closed state, the closure element or closure part thereof is held on the connection in a latching or form-fit or interlocking manner by means of at least one retaining element which is at least one of arranged or integrally molded on the closure element.

13. Cartridge according to claim 3, wherein the operating position of the cartridge is a position, in which the plate plane or main plane of at least one of the cartridge and the main body is vertically oriented.

14. Cartridge according to claim 8, wherein the inner projection is a ridge-shaped projection.

15. Cartridge according to claim 1, wherein at least one of the closure element and a closure part thereof is multi-component injection-molded.

16. Cartridge according to claim 2, wherein a said valve is also associated with the intermediate connection of the receiving cavity.

17. Cartridge according to claim 1, further comprising at least one additional valve which is open in at least one of a storage-stable state, an inoperative position, an initial state or when the cartridge is not inserted into the analysis device.

18. Cartridge according to claim 1, wherein each valve associated with each of the inlet and the outlet are adapted for only being opened by the analysis device when the cartridge is inserted therein.

19. Cartridge according to claim 3, further comprising a valve that is closed in a delivery state of the cartridge, said valve being associated with the intermediate connection and being adapted for being opened by the analysis device.

20. Cartridge for testing a sample and which is receivable in an analysis device, comprising:
- a main body having a plurality of channels and cavities, and
- a cover for the channels and cavities,
- wherein the said cavities comprise a receiving cavity having a connection for receiving the sample,
- wherein a closure element is provided for fluidically closing the connection,
- wherein the receiving cavity comprises an inlet and an outlet, in addition to the connection, and
- further comprising a valve that is closed in a delivery state of the cartridge, a respective said valve being associated with each of the inlet and the outlet of the receiving cavity, each valve being adapted for being opened by the analysis device,
- further comprising at least one additional normally open valve associated with each of the inlet and the outlet of the receiving cavity, each normally open valve being open in at least one of a storage-stable state, an inoperative position, an initial state or when the cartridge is not inserted into the analysis device, and being adapted to be closed by the analysis device.

21. Cartridge for testing a sample and which is receivable in an analysis device, comprising:
- a main body having a plurality of channels and cavities, and
- a cover for the channels and cavities,
- wherein the said cavities comprise a receiving cavity having a connection for receiving the sample,
- wherein a closure element is provided for fluidically closing the connection,
- wherein the receiving cavity comprises an inlet, an outlet, and an intermediate connection, in addition to the connection,
- further comprising a valve that is closed in a delivery state of the cartridge, a respective said valve being associated with each of the inlet, the outlet, and the intermediate connection of the receiving cavity, each valve being adapted for being opened by the analysis device.

22. Cartridge according to claim 21, further comprising at least one additional normally open valve being associated with each of the inlet, the outlet, and the intermediate connection of the receiving cavity, each normally open valve being open in at least one of a storage-stable state, an inoperative position, an initial state or when the cartridge is not inserted into the analysis device, and being adapted to be closed by the analysis device.

* * * * *